US008409120B2

(12) United States Patent
Knyrim

(10) Patent No.: US 8,409,120 B2
(45) Date of Patent: Apr. 2, 2013

(54) MASSAGING DEVICE FOR THE MALE GENITAL ORGAN

(76) Inventor: Jörg Knyrim, Karlsruhe (DE)

( * ) Notice: Subject to any disclaimer, the term of this patent is extended or adjusted under 35 U.S.C. 154(b) by 663 days.

(21) Appl. No.: 12/591,682

(22) Filed: Nov. 27, 2009

(65) Prior Publication Data

US 2010/0152631 A1 Jun. 17, 2010

(30) Foreign Application Priority Data

Nov. 28, 2008 (DE) ..... 10 2008 059 460
Nov. 3, 2009 (DE) ..... 10 2009 051 639

(51) Int. Cl.
*A61H 7/00* (2006.01)
*A61H 19/00* (2006.01)

(52) U.S. Cl. ..... 601/89; 601/46; 601/53; 600/38

(58) Field of Classification Search ..... 600/38; 601/46, 61, 63, 72, 80, 85, 87, 97, 101–103, 601/112–114, 118–120, 122, 123, 125, 126, 601/129, 130, 137, 53, 89
See application file for complete search history.

(56) References Cited

U.S. PATENT DOCUMENTS

| | | | |
|---|---|---|---|
| 2004/0082831 | A1 | 4/2004 | Kobashikawa et al. |
| 2010/0041944 | A1* | 2/2010 | Levy ..... 600/38 |

FOREIGN PATENT DOCUMENTS

| | | |
|---|---|---|
| AU | 2004200826 | 9/2005 |
| DE | 2604511 | 8/1977 |
| DE | 2606869 | 9/1977 |
| DE | 9201194 | 5/1992 |
| DE | 9318794 | 3/1994 |
| DE | 29907732 | 11/1999 |
| DE | 19836805 | 2/2000 |
| DE | 202004011565 | 11/2004 |
| WO | WO2004/036369 | 4/2004 |
| WO | WO2005/084605 | 9/2005 |
| WO | WO2005099366 | 10/2005 |

* cited by examiner

*Primary Examiner* — Tatyana Zalukaeva
*Assistant Examiner* — Kari Petrik
(74) *Attorney, Agent, or Firm* — Welsh Flaxman & Gitler LLC

(57) ABSTRACT

The invention relates to a massaging device with an elongated massaging recess for receiving a male genital organ, in which for massaging a male genital organ received in the elongated massaging recess a drive mechanism is provided extending along the longitudinal axis (LA) of the massaging recess. It is especially advantageous that the drive mechanism has a plurality of bearing surfaces, which are arranged at a radial distance from the longitudinal axis (LA) and which at least sectionwise surround the elongated massaging recess. A further advantage is that the drive mechanism is designed for an oscillating deformation of the elongated massaging recess at least radially inward along the longitudinal axis (LA) of the elongated massaging recess.

22 Claims, 10 Drawing Sheets

MASSAGING DEVICE FOR THE MALE GENITAL ORGAN

BACKGROUND OF THE INVENTION

The invention relates to a massaging device for the male genital organ with an elongated massaging recess for receiving the male genital organ.

The existing art is familiar with numerous massaging devices for sexual stimulation of a male genital organ, in particular a human penis.

The goal of such massaging devices is to apply vibrations to the male genital organ to achieve excitation of the male genital organ. One primary problem with such massaging devices is the unusual manner of stimulation, which differs from that of natural sexual intercourse.

From this point of departure, it is an object of the invention to present a massaging device with a new type of drive mechanism for generating a massaging motion that achieves stimulation of the male genital organ in a manner that is as natural as possible.

SUMMARY OF THE INVENTION

An essential aspect of the massaging device, according to the invention, is the fact that the drive mechanism comprises a plurality of bearing surfaces, which are arranged at a radial distance from the longitudinal axis and which at least sectionwise enclose the elongated massaging recess and that the drive mechanism is designed for an oscillating deformation of the elongated massaging recess at least radially inward along the longitudinal axis of the elongated massaging recess. The oscillating radial deformation of the elongated massaging recess, along the longitudinal axis of the massaging recess, achieves particularly advantageous massaging of the male genital organ held in the elongated massaging recess and therefore a stimulation that is as natural as possible.

A further advantage is that the oscillating deformation along the longitudinal axis of the elongated massaging recess and/or in the circumferential direction of the elongated massaging recess is preferably out of phase. This achieves a wave-like deformation of the elongated massaging recess, for example, in the form of a wave progressing along the longitudinal axis of the massaging recess.

Advantageously, several bearing surfaces are arranged concentrically around the longitudinal axis or radially offset to the longitudinal axis of the massaging recess or radially offset to the longitudinal axis of the massaging recess.

The elongated massaging recess can be formed by an at least sectionwise tubular formed part made of a rubber-elastic material and the bearing surfaces can bear at least partially on the lateral surface of the elastic formed part.

In a preferred embodiment, several bearing surfaces are arranged concentrically around the longitudinal axis of the massaging recess. The oscillating deformation advantageously along the longitudinal axis of the elongated massaging recess and/or in the circumferential direction of the elongated massaging recess is preferably out of phase.

Advantageously, the drive mechanism is designed for a wave-like deformation of the elongated massaging recess, namely in the form of a wave progressing along the longitudinal axis of the elongated massaging recess.

In particular, it is advantageous for one bearing surface to be formed by at least one drivable shaft comprising at least one eccentric section.

Further, the bearing surfaces can be formed by a plurality of bearing elements, in which case several bearing elements arranged respectively along the longitudinal axis can be driven by means of at least one shaft to produce a radial stroke movement. For this purpose, the bearing elements comprise at least one guide opening respectively for holding the at least one shaft. It is especially advantageous for the bearing elements to be jaws, disks, balls and/or bristles.

The bearing elements are made of a solid or elastically deformable material, for example of metal, plastic, elastomer, foamed polyurethane or any combination of these materials. In particular, the bearing elements are designed differently at least sectionwise along the longitudinal axis. For example, several support elements can be arranged in a common plane perpendicular to the longitudinal axis of the elongated massaging recess and form one group of support elements, and a plurality of such groups can be provided successively along the longitudinal axis of the elongated massaging recess.

In a further embodiment a plurality of successive, at least sectionwise circular ring-shaped bearing elements with at least one guide opening are provided along the longitudinal axis of the elongated massaging recess. At least one rod-shaped guide or support element is guided through the at least one guide opening.

On the at least one rod-shaped guide or support element, several jaw-shaped or at least sectionwise circular ring-shaped bearing elements are advantageously lined up, the at least one rod-shaped guide or support element being approximately parallel to the longitudinal axis of the holding space and arranged at a distance to said axis. Preferably several such rod-shaped guide or support elements with lined-up bearing elements are provided concentrically around the longitudinal axis. Further, for driving the bearing elements lined up on a rod-shaped guide or support element, the at least one shaft acts upon one circumferential side of the bearing elements.

For moving the support surfaces and/or the support elements forming said support surfaces, it is advantageous to provide at least one shaft comprising at least one eccentric section and interacting with the support elements and that can be driven by a drive unit. The at least one eccentric section extends parallel or approximately parallel to the longitudinal axis of the shaft at least over a partial length of the at least one shaft. Also, the at least one eccentric section can extend diagonally to the longitudinal axis of the shaft over a partial length of the at least one shaft or have a twisted design at least over a partial length of the at least one shaft, namely so that it extends spirally around the longitudinal axis of the shaft.

Advantageously, the at least one eccentric section is formed by one edge of the at least one shaft and the eccentric section is designed so that the at least one shaft at least partially has a non-circular cross section, for example a polygonal, essentially polygonal or oval cross section. Preferably at least the eccentric section is surrounded by an elastically deformable material, in particular an elastomer or a foamed polyurethane material.

Further embodiments of the invention ensue from the following description of exemplary embodiments and the drawings. All characteristics described and/or represented, alone or in any combination, are subject matter of the invention, regardless of their being summarized or referenced in the claims.

BRIEF DESCRIPTION OF THE DRAWINGS

The invention is described in more detail below based on exemplary embodiments with reference to several drawings, in which:

FIGS. 1, 2, 5 and 6, respectively, show a massaging device 1 for massaging a male genital organ, in particular a penis, in a longitudinal section view, where the longitudinal axis LA of the massaging device 1 extends in the X-Y plane of a corresponding Cartesian coordinate system.

Figure 2:
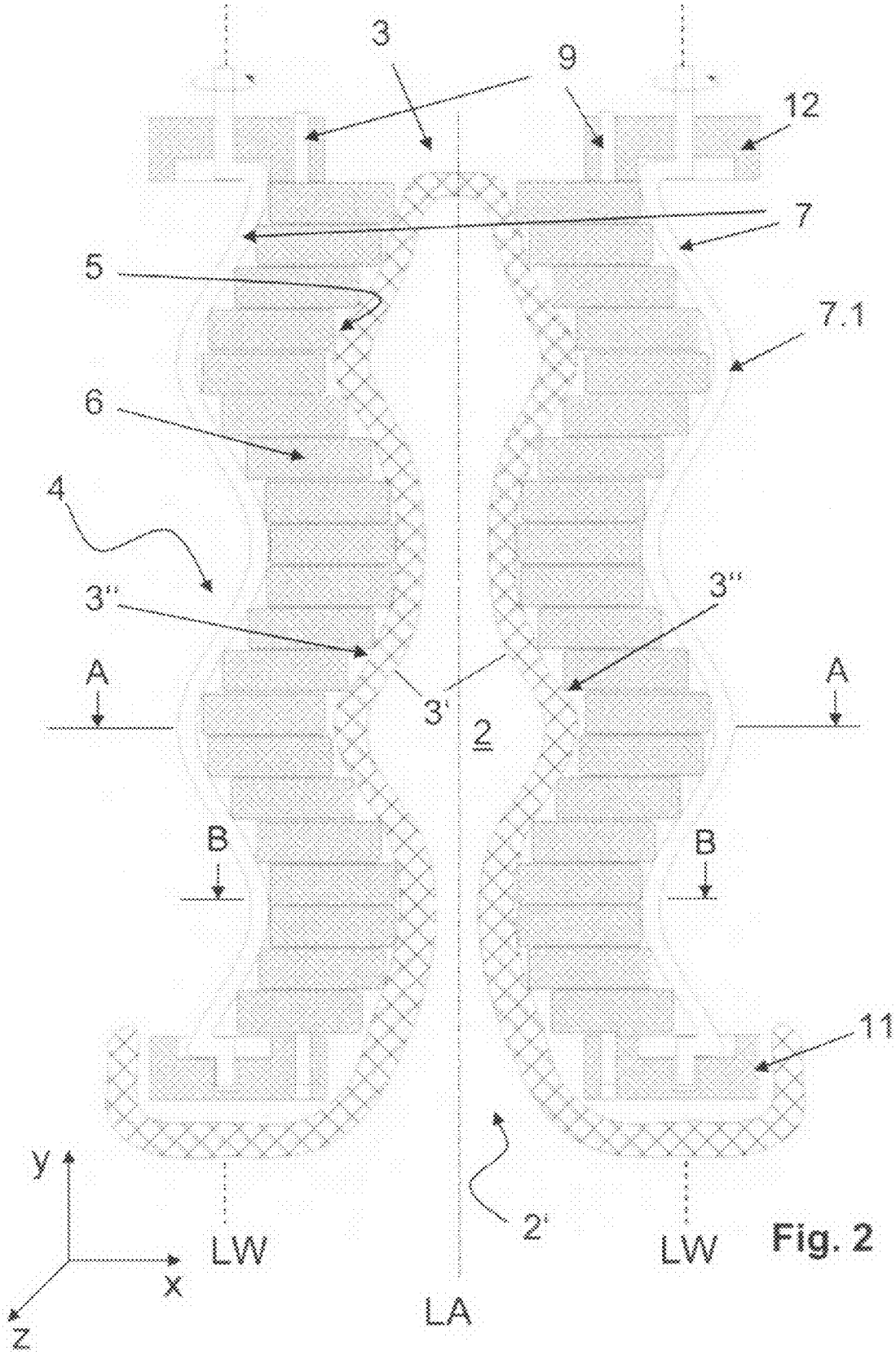
FIG. 2 is a side view of a massaging device according to the invention in FIG. 1 with a tubular formed part.
Figure 6:
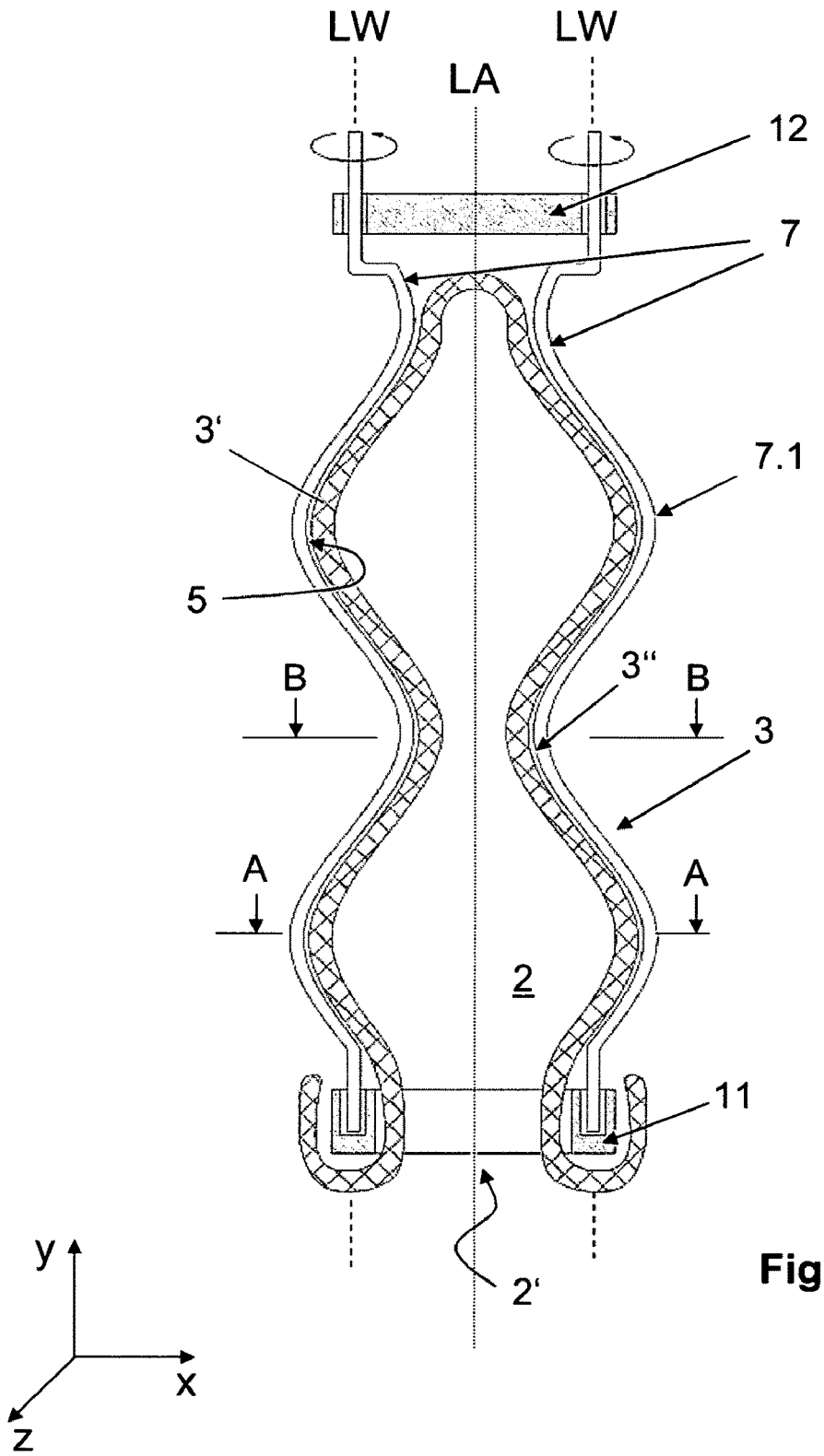
FIG. 6 is a side view of a further embodiment of the massaging device with a tubular formed part according to the invention in FIG. 1.

The massaging device 1 comprises an elongated massaging recess 2 for receiving the male genital organ, with a drive mechanism 4 for deformation of the elongated massaging recess 2. The elongated massaging recess 2 can, as shown in FIGS. 2 and 6, be formed at least partially by a tubular formed part 3 made of a rubber-elastic material. For illustration of the function of the massaging device 1, according to the invention, the drawings show only the components of the massaging device 1 without the housing that accommodates the components.

The elongated massaging recess 2 of the massaging device 1 is essentially tubular or hollow cylindrical in shape, and on at least one end of the elongated massaging recess 7 an opening 2' is provided for insertion of the penis to be stimulated into the elongated massaging recess 2. Preferably the end of the elongated massaging recess 2 opposite the opening 2' is closed, for example, so that it contains a holding space for the ejaculate.

In a preferred embodiment, the elongated massaging recess 2 is at least partially lined with an elastic formed part 3, which is designed as one piece and at least sectionwise comprises a wall 3' surrounding the longitudinal axis LA approximately concentrically. The elastic formed part 3 or its wall 3' adapts with the outer lateral surface 3" to the contour defined by the drive mechanism 4. In addition, the elastic formed part 3 is preferably reverse drawn over the end opening 2' and fixed there.

Further, a drive mechanism 4 at least sectionwise radially surrounding the elongated massaging recess 2 is provided along the longitudinal axis LA, which (drive mechanism) is designed for an oscillating deformation of the elongated massaging recess 2 at least radially inward, namely relative to the longitudinal axis LA of the elongated massaging recess 2. The oscillating deformation can take place along the longitudinal axis LA of the elongated massaging recess 2 and/or in the circumferential direction of the elongated massaging recess 2 preferably out of phase, producing an approximately wave-like deformation of the massaging recess 2, in the form of a wave progressing along the longitudinal axis LA of the elongated massaging recess 2.

The drive mechanism 4 comprises, for this purpose, a plurality of bearing surfaces 5, which surround the elongated massaging recess 2 and are arranged concentrically to its longitudinal axis LA, and the bearing surfaces 5, in the case of the massaging recess 2 being lined with an elastic formed part 3, at least partially bear against its lateral surface 3". The bearing surfaces 5 can be formed by different mechanical components, which are explained exemplarily in the following.

The drive mechanism 4 can, for example, comprise several guide and support elements 9 fixed between a first support element 11 and an opposing second support element 12, and firmly connected with the support elements 11, 12. The guide and support elements 9 are designed, for example, in the form of a rod or bar and are oriented approximately in the direction of the longitudinal axis LA of the massaging device 1.

Between the first support element 11 and the second support element 12, which is at a distance from the first support element 11, a plurality of bearing elements 6 is arranged, each bearing element 6 comprising at least one guide opening 3, and at least one guide or support element 9 being guided through this guide opening 8. The guide openings 8 are designed so that a radial displacement of the bearing elements 6 in the X-Z plane is possible, i.e. from the outside to the inside and vice versa, respectively in relation to the longitudinal axis LA. Preferably the guide opening 8 is oval or oblong in shape.

Figure 3:
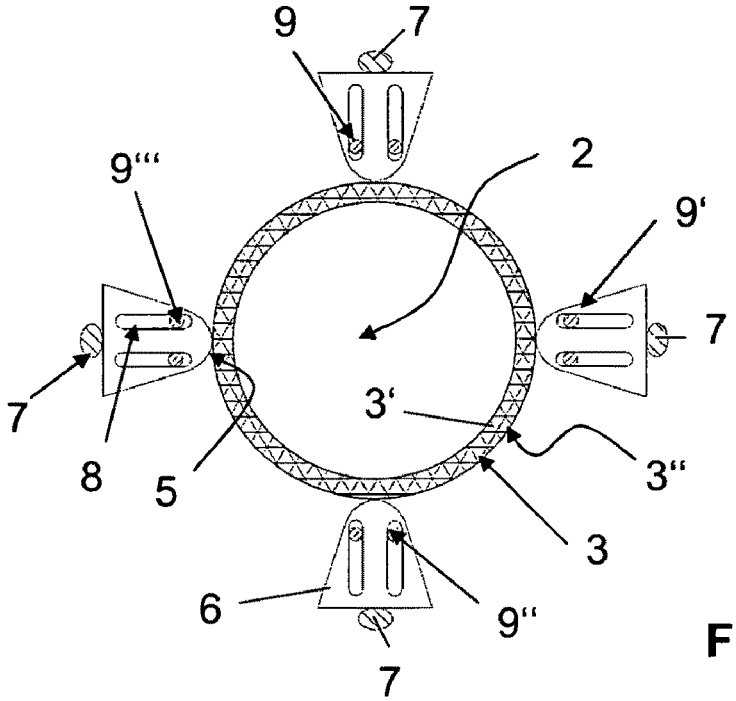
FIG. 3 is a cross section through the massaging device of FIG. 2 along the line A-A.
Figure 4:
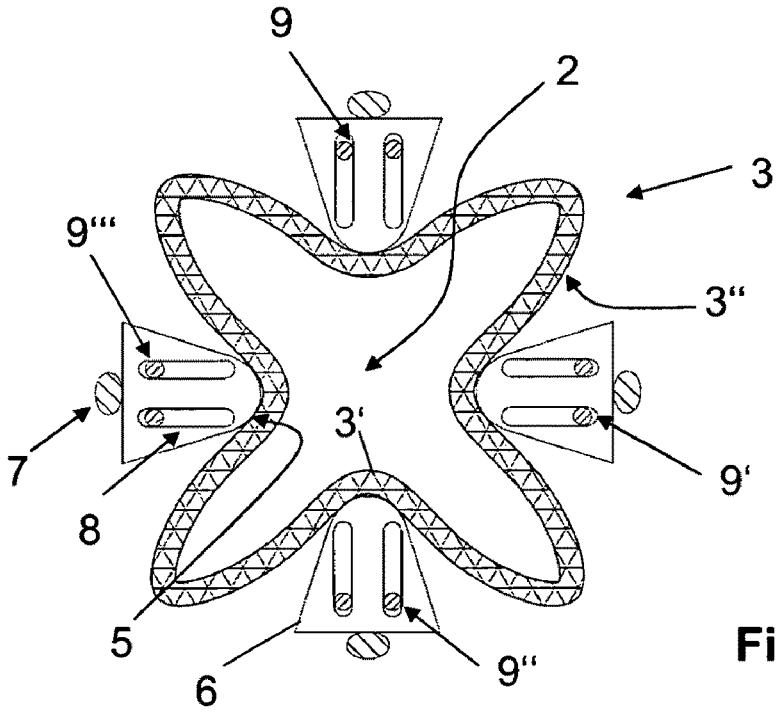
FIG. 4 is a cross section through the massaging device of FIG. 2 along the line B-B.

FIGS. 3 and 4 show a cross section through the massaging device 1 of FIG. 2 along the lines A-A and B-B. In the depicted embodiment, first through fourth guide and support elements 9, 9', 9", 9'" are provided between the first and second guide and support elements 11, 12, the guide and support elements 9, 9', 9", 9'" being offset from each other by 90° respectively and arranged concentrically around the longitudinal axis LA of the massaging device 1, namely so that the first through fourth guide and support element 9, 9', 9", 9'" have the same respective distance to the longitudinal axis LA.

The surface sections of the bearing elements 6 oriented in the direction of the longitudinal axis LA form the bearing surfaces 5 for the outer lateral surface 3" of the elastic formed part 3. The surface sections of the bearing elements 6 opposite these bearing surfaces 5 bear against at least one shaft 7, and the longitudinal axis LW of the shaft 7 is approximately parallel to the longitudinal axis LA of the massaging device 1 and is at a distance from the latter. The shaft 7 is preferably rotatably mounted in the first and second support element 11, 12 and can be driven on its respective longitudinal axis LW by means of a drive unit not depicted in the drawings.

In the area between the first support element 11 and the second support element 12 the shaft 7 comprises at least one eccentric section 7.1, which interacts with the surface sections of the bearing elements 6 facing away from the longitudinal axis LA, and displaces these bearing elements 6 radially to the longitudinal axis LA during rotation of the shaft 7, i.e. produces a radial stroke movement. This radial stroke movement of the bearing elements 6 causes deformation of the elastic formed part 3 or at least of its wall 3'. The guide opening 8 of the bearing elements 6 can likewise be designed for holding the shaft 7, so that the bearing elements 6 are both guided and driven by the shaft 7.

Several bearing elements 6 can be provided in a common plane along the circumference of the elastic formed part 3, and these bearing elements 6 can be distributed approximately equally along the circumference of the elastic formed part 3 or concentrated in certain angle sectors. The bearing elements 6 are in turn lined up on the guide and support elements 9, producing a "stack" of bearing elements 6 in the Y-direction that is preferably driven by means of an allocated shaft 7. The bearing elements 6 shown in FIGS. 2 and 3 are arranged in a common X-Z plane perpendicular to the longitudinal axis LA and therefore form a group of bearing elements 6, a plurality of such groups being arranged consecutively along the longitudinal axis LA of the massaging device 1 to form the "stack".

Figure 1:
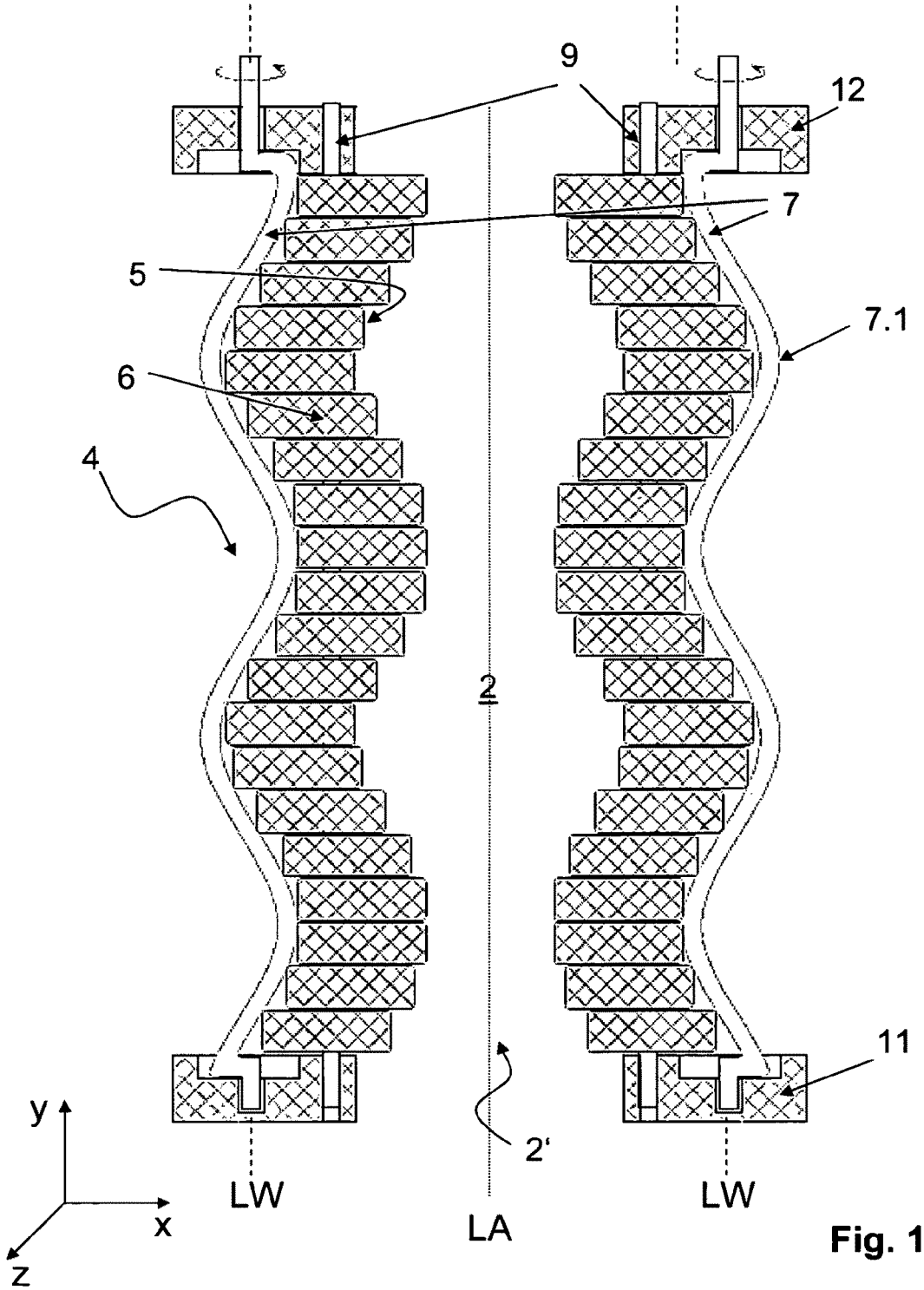
FIG. 1 is a side view of a massaging device according to the invention in longitudinal section.

The bearing elements 6 in the exemplary embodiment of FIGS. 1 and 2 are formed by approximately conical jaw elements with rounded bearing surfaces 5, with two oblong holes extending parallel to each other being provided as guide openings 8. In deviation from this, the bearing elements 6 can have a wide variety of forms, namely for example the form of balls or disks.

Alternatively, a plurality of successive, at least partially circular bearing elements 6 with an inner opening can be provided along the longitudinal axis of the massaging device 1, which, arranged concentrically to the longitudinal axis LA, form the preferably circular inner openings. The elastic formed part 3 is at least partially held in or guided through the circular inner opening formed by the bearing elements 6.

The driving of the bearing elements 6 therefore results from interacting of the shaft 7 with the guide and support elements 9. The bearing elements 6 are movably arranged by means of the guide and support elements 9 guided through the guide holes 8 and mounted immovably relative to the longitudinal axis LA of the massaging device 1 and guided through the inner surfaces of the guide openings 8 so that a displacement can take place only in radial direction relative to the longitudinal axis LA of the massaging device 1, each bearing element 6 is therefore movable nearly independent of the adjacent bearing elements 6 above and below, namely preferably in a plane extending perpendicular to the longitudinal axis LA of the massaging device 1.

To produce the desired massaging movement the bearing surface 5 of the bearing element 6 bearing against the shaft 7 can have different forms or surface characteristics. Also, the shaft 7 can have different cross sectional forms, for example oval, round or polygonal. In case of use of the guide opening 8 for driving the bearing element 6, the opening can likewise have different forms, for example round, oval or oblong.

In the embodiment depicted in FIGS. 3 and 4, the guide openings 8 of the bearing elements 6 are designed in pairs of oblong holes, the oblong holes being aligned radially to the longitudinal axis LA of the massaging device 1, and perpendicular thereto the size of the opening of the oblong holes corresponds approximately to the outer diameter of the round guide and support elements 9. The surface sections of the bearing elements 6 bearing against the shaft 7 are at least sectionwise straight and flat, while the cross section of the shaft 7 itself is oval. The form of the guide openings 8, the form or surface quality of the surface sections of the bearing elements 6 linked to the shaft 7 on the one hand and the design of the shaft 7 on the other hand results in a cam, which defines the extent of movement or the stroke of the respective bearing elements 6 in the plane extending perpendicular to the longitudinal axis LA of the massaging device 1 based on the angle of rotation of the shaft 7.

For driving the bearing elements 6, shafts 7 of a wide variety of forms can be used, for example, preferably with at least one eccentric section 7.1, in particular shafts such as those depicted in FIGS. 9*a* and 9*b* or FIGS. 10*a* and 10*b*, these shafts however exemplarily comprising several eccentric sections 7.1. The drawings show in depiction a) and b) the same shaft 7, respectively, however the respective shaft 7 in Figure b) is turned 90° along the longitudinal axis LW as compared with the shaft in Figure a), and in the embodiment depicted in FIGS. 9*a*) and 9*b*) the shaft 7 has a spiral path around the respective longitudinal axis LW of the shaft. The shaft 7 depicted in FIGS. 10*a*) and 10*b*) shows several eccentric sections 7.1 in the form of oscillations around the shaft longitudinal axis LW, all eccentric sections 7.1 lying in one plane, so that in a two-dimensional depiction turned 90°, as in FIG. 8*b*), no eccentric section 7.1 is visible. The use of a shaft 7 with a single eccentric section 7.1 is also conceivable.

Depending on the design of the shaft 7 in interaction with the above described embodiment of the guide openings 8 and of the surface sections coming into contact with the shaft 7, a displacement of the respective bearing element 6 occurs in the plane extending perpendicular to the longitudinal axis LA of the massaging device 1 and therefore in the overall view of the massaging device 1 a preferably sinus wave shaped stroke movement of the bearing elements 6 progressing along the longitudinal axis LA. These different stroke movements of the plurality of the support surfaces 5 of the bearing elements 6 are converted into an oscillating radial deformation of the massaging recess 2 or of the elastic formed part 3.

Alternatively, the shaft 7 can be designed with a deviating form, namely at least over a partial length parallel or approximately parallel to the longitudinal axis LA of the shaft 7, at least over a partial length of the shaft 7 diagonal to the longitudinal axis LW of the shaft 7. Also, the at least one eccentric section 7.1 of the shaft 7 can be formed by one edge of the shaft 7.

In an alternative embodiment according to FIGS. 5 through 8 the bearing surfaces 5, instead of being formed by separate bearing elements 6, are formed by the lateral surface or edges of the respective shaft 7 itself. The longitudinal axes LW of the shafts 7 are oriented approximately parallel to the longitudinal axis LA of the massaging device 1, preferably at the same radial distance to the longitudinal axis LA. These shafts 7 are rotatably mounted in the first and second support elements 11, 12 and can be driven, preferably synchronously, by means of a drive unit not depicted.

Figure 7:
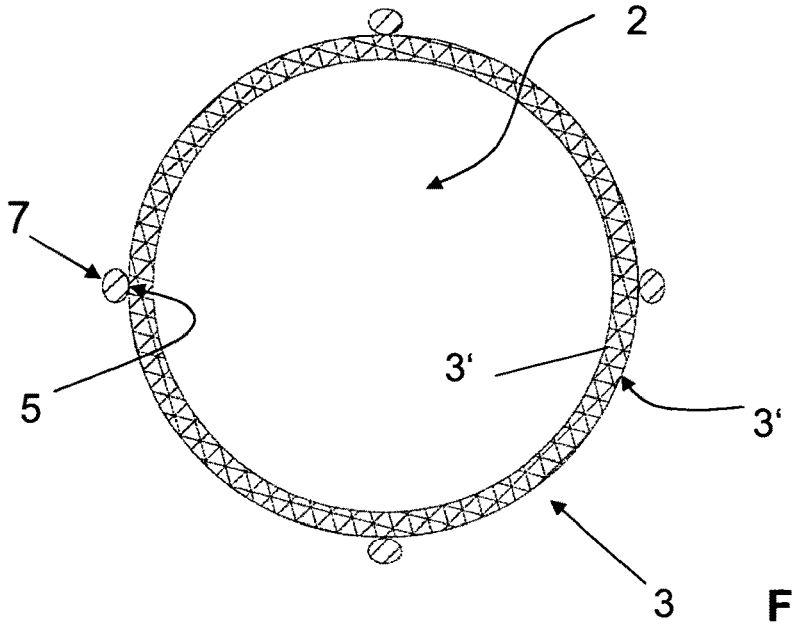
FIG. 7 is a cross section through the massaging device of FIG. 6 along the line A-A.
Figure 8:
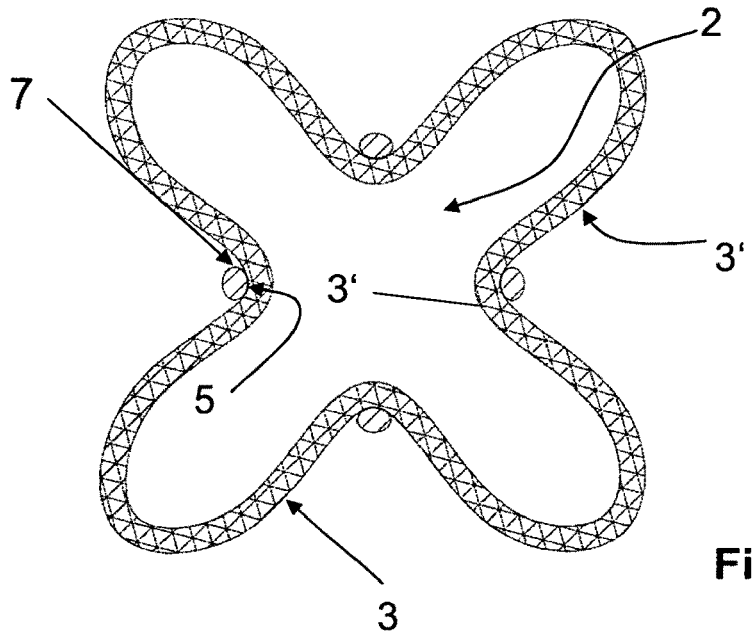
FIG. 8 is a cross section through the massaging device of FIG. 6 along the line B-B.
Figure 9:
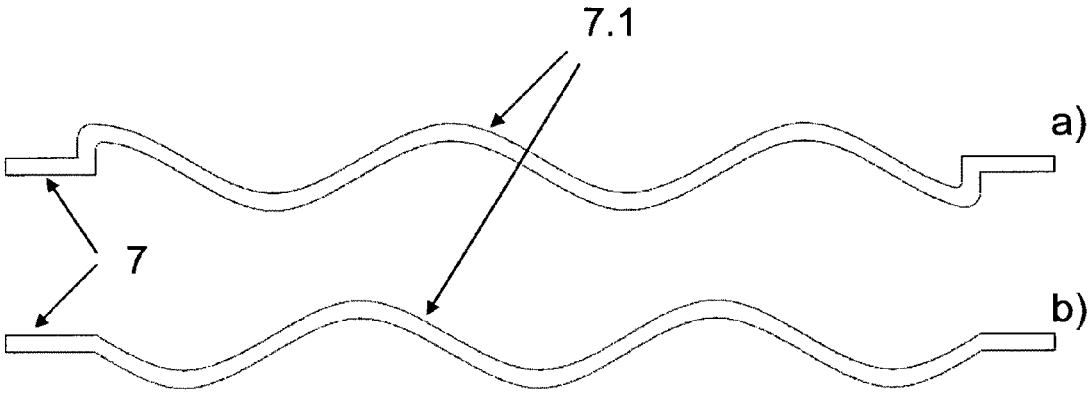
FIG. 9 *a, b* are two exemplary side views of shafts in a first embodiment.
Figure 10:
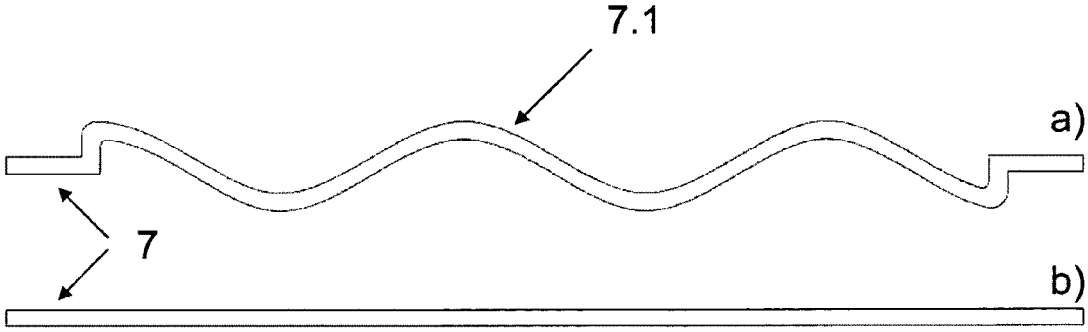
FIG. 10 *a, b* are two exemplary side views of alternative shafts in a second embodiment.

In the exemplary embodiment shown here, shafts 7 such as those shown in FIGS. 9*a* and 9*b* are used. They comprise several eccentric sections 7.1 arranged along the longitudinal axis LW of the shaft 7. In FIGS. 6 through 8, the elastic formed part 3 adapts with the outer lateral surface 3" to this spiral shaped wave form. To achieve a more pleasant massaging effect, the shafts 7 or at least the eccentric section 7.1 can be surrounded by an elastically deformable material, in particular an elastomer or a foamed polyurethane material. This achieves a larger bearing surface 5 to the formed part 3 and therefore prevents an unpleasant effect of the at least one eccentric section 7.1 of the shaft 7 by the elastic formed part 7 on the male genital organ.

Alternatively, ball-shaped, disk-shaped or otherwise shaped bearing elements 6 provided with a drive opening can be lined up on the shaft 7 at least along a partial area of the shaft 7 for increasing the stimulating effect. The cross section of the massaging recess 2 at least partially described by the outer surface of the shafts 7 or of the bearing elements 6 lined up on the shafts 7 or the elastic formed part 3 interacting with the outer surface of the shafts 7 or of the bearing elements 6 lined up on the shafts 7 is changed at least sectionwise along the longitudinal axis LA upon applying a rotary motion to the shafts 7.

Depending on the rotary angle of the shafts 7 oriented along the circumference preferably at regular angle intervals, a periodic enlargement or reduction of the diameter of the elongated massaging recess 2 or an enlargement or contraction of the elastic formed part 3 or of its wall 3' is achieved. This produces an oscillating stroke movement progressing along the longitudinal axis LA of the massaging device 1, preferably a wavelike deformation of the massaging recess 2 or of the elastic formed part 3.

In this embodiment, the desired massaging effect can be selected by the number of the shafts 7 used along the circumference of the sleeve 3, the form or design of the eccentric sections 7.1 and of the cross sectional form of the shafts 7. Also, the massaging effect can be modified or increased by varying the rotary speed or the rotary direction of the shafts 7. In particular, the shafts 7 distributed along the circumference of the massaging recess 2 can be actuated so that the deformation produced by a shaft 7 is out of phase with the deformation produced by the adjacent shaft 7.

Figure 5:
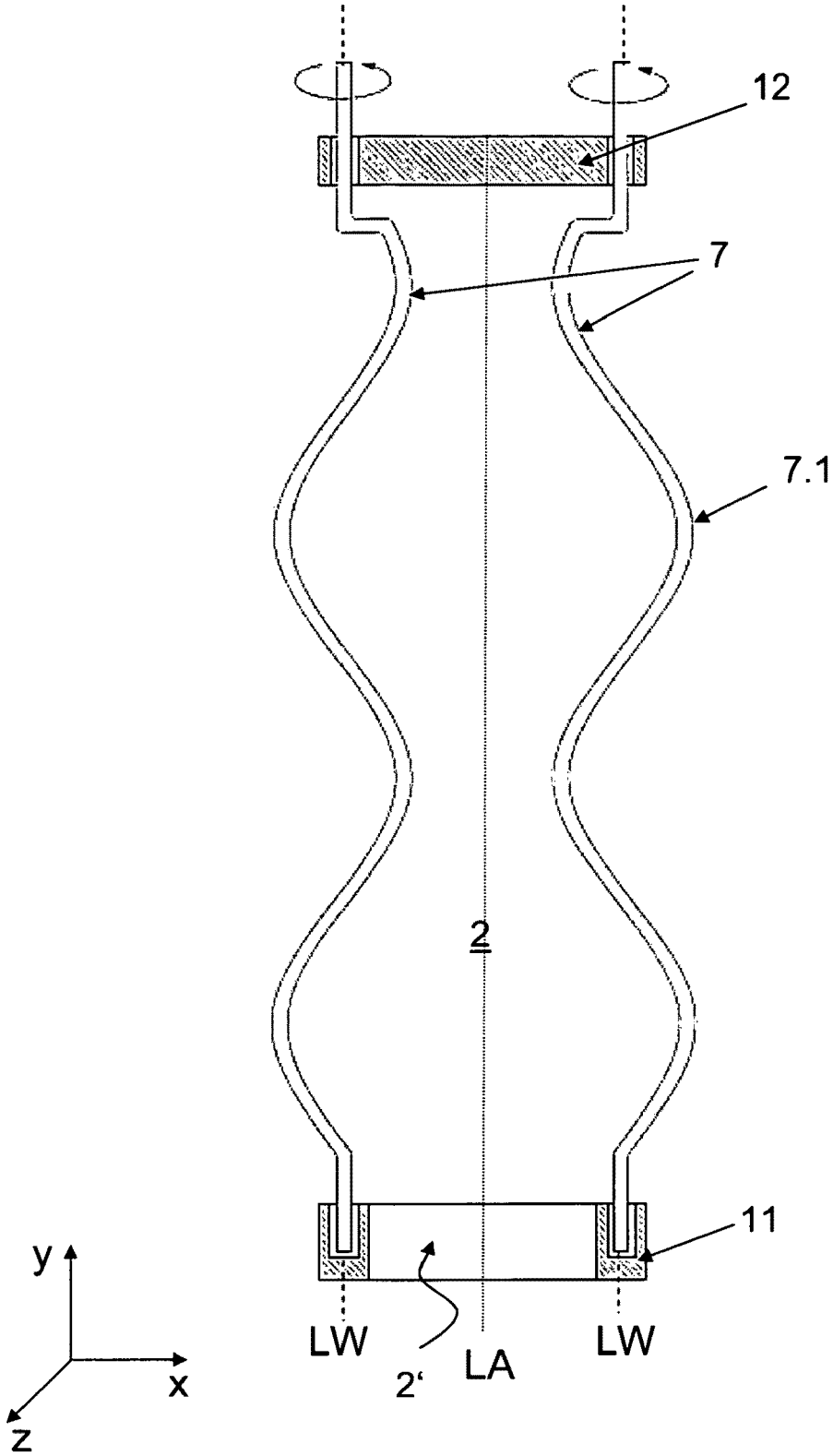
FIG. 5 is a side view of a further embodiment of the massaging device according to the invention in longitudinal section.

Alternatively to the embodiment of the shafts 7 shown in FIGS. 5 and 6, said shafts can have virtually any form, the shaft 7 being suitable by means of suitable actuation to cause a deformation, for example a sinus wave shaped deformation, of the massaging recess 2 progressing along the longitudinal axis LA of the massaging device 1.

In particular, the at least one eccentric section 7.1 can extend parallel, approximately parallel or diagonally to the longitudinal axis LW of the shaft 7 at least over a partial length of the at least one shaft 7. Also, the at least one eccentric section 7.1 can be formed by one edge of the at least one shaft.

Figure 11:
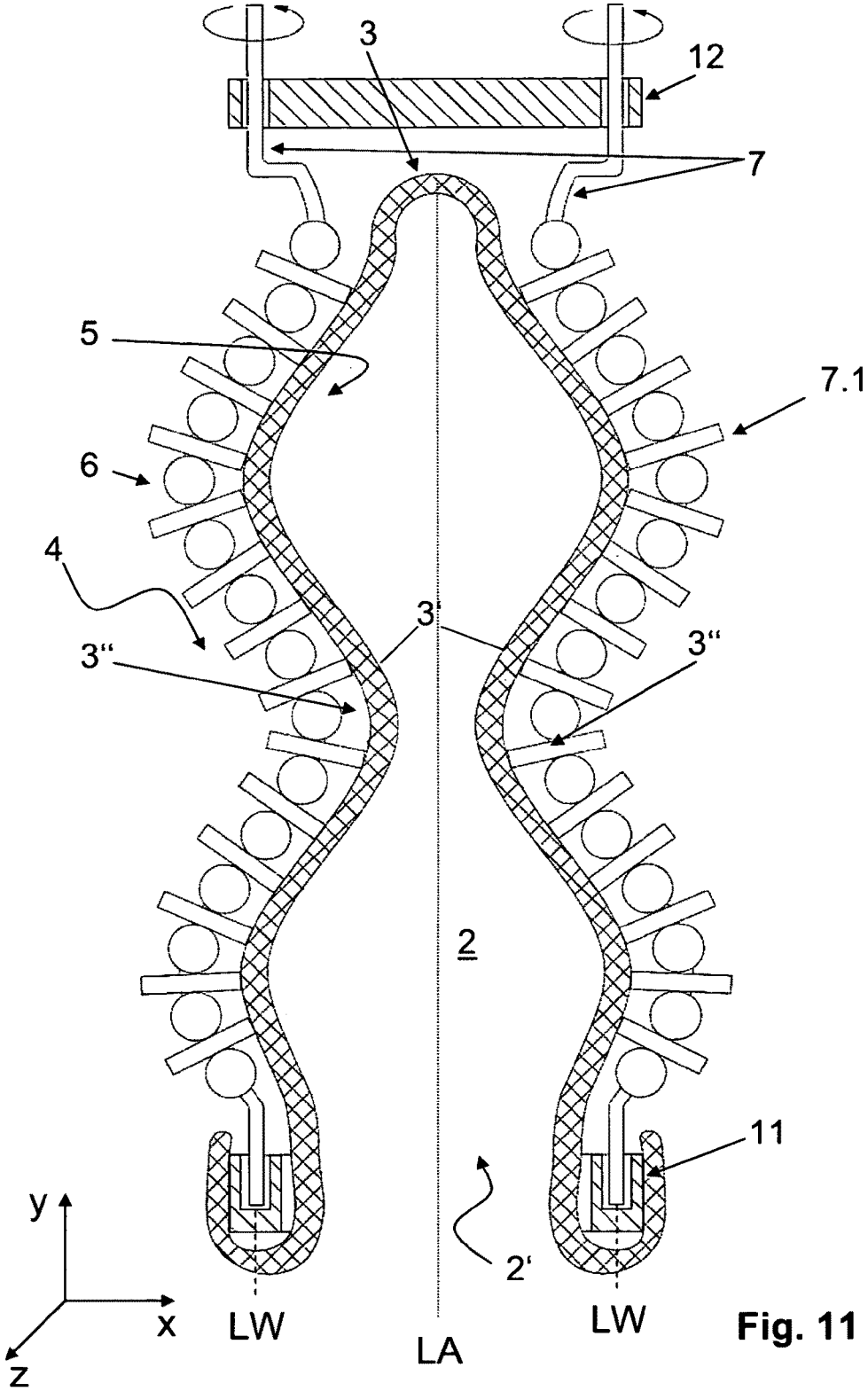
FIGS. 11, 12 are side views of alternative embodiments of the massaging device according to the invention in longitudinal section

FIG. 11 shows a further embodiment of a massaging device according to the invention. On the shafts 7 bearing elements 6 are lined up, which bear at least partially on the circumferential side across from the tubular formed part 3 on its outer lateral surface 3"; differently formed bearing elements 6 are provided, for example in the form of balls and disks, preferably alternating periodically or at least sectionwise. These different bearing elements 6 can be made in particular of different materials. Preferably the disk-shaped bearing elements 6 protruding radially over the ball-shaped bearing elements 6 are made of a soft, elastically deformable material, for example of an elastomer, while the balls are made of a hard material, in particular plastic or metal. These balls serve as spacers for the disk-shaped bearing elements 6. The deformability of the disk-shaped bearing elements 6 achieves, in addition to the deformation of the tubular formed part 3 caused by the rotation of the shafts 7, an additional massaging effect by the reversible deformation of the disk-shaped bearing elements 6 during the effect on the male genital organ.

Figure 12:
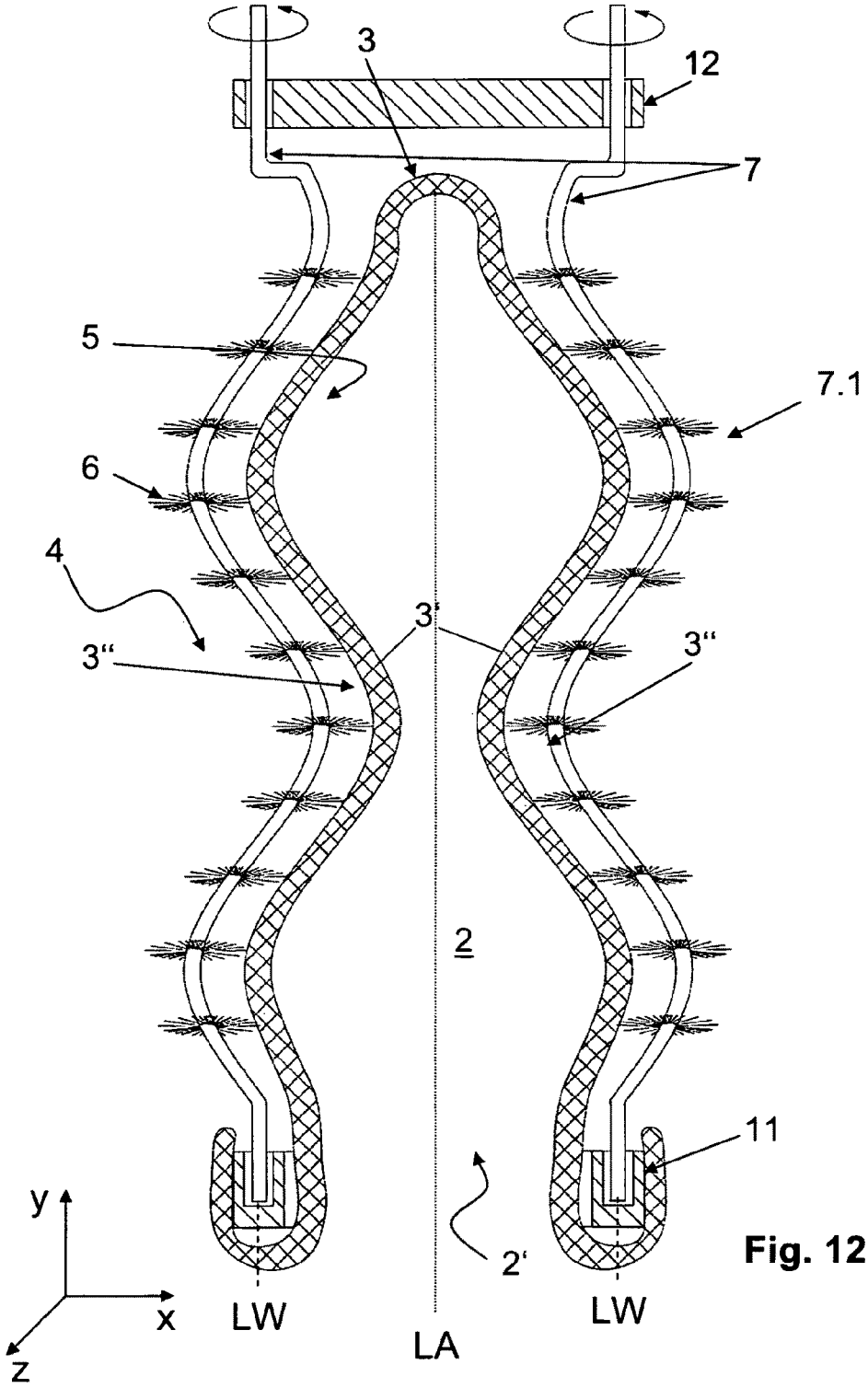
Figure 13:
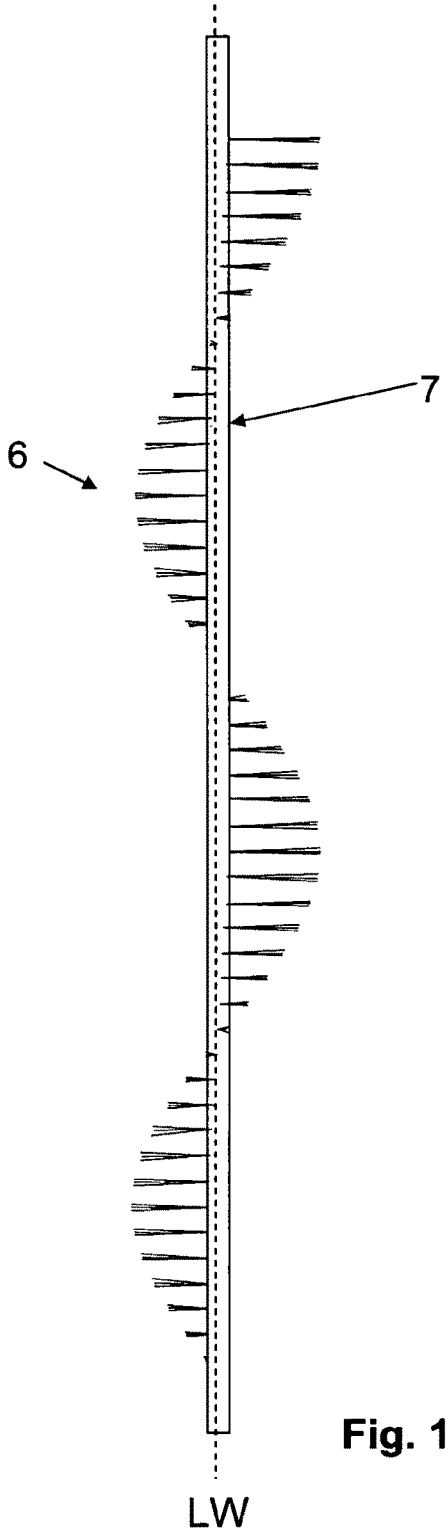
FIG. 13 is a side view of an embodiment of a shaft with bristles.

FIG. 12 shows a further possible embodiment of the bearing elements 6 arranged on the shafts 7, which (bearing elements) have a bristle-like design and stick out radially from the shaft 7. The bristles are made of a reversible deformable material, in particular of an elastomer. They form the bearing surfaces 5 opposite the tubular formed part 3 and are deformed by bearing against the tubular formed part 3 during the massage of the male genital organ, likewise resulting in an increased massaging effect. It is alternatively possible to form the bearing elements 6 so that the bearing surfaces 5 formed by said bearing elements have a different radial distance from the longitudinal axis LW of the shaft (FIG. 13). For example, the bristle-like bearing elements 6 can have different lengths, which change constantly, sectionwise constantly or stepwise along the longitudinal axis LW of the shaft. In deviation from this design, bristles with a constant length can be arranged helically on the shaft 7.

The invention was described above based on several exemplary embodiments. It goes without saying that numerous modifications and variations are possible without abandoning the underlying inventive idea upon which the invention is based.

Reference List

1 massaging device
2 massaging recess
2' opening
3 tubular formed part
3' wall
3" outer lateral surface
4 drive mechanism
5 bearing surface
6 bearing element
7 shaft
7.1 eccentric section
8 guide opening
9, 9', 9", 9'" guide and support element
11 first support element
12 second support element
LA longitudinal axis of massaging device
LW longitudinal axis of shaft

What is claimed is:

1. A massaging device with an elongated massaging recess for receiving a male genital organ, in which for massaging a male genital organ received in the elongated massaging recess a drive mechanism is provided extending along a longitudinal axis (LA) of the massaging recess, wherein the drive mechanism comprises a plurality of bearing surfaces, which are arranged at a radial distance from the longitudinal axis (LA) and which at least sectionwise enclose the elongated massaging recess and that the drive mechanism is for an oscillating deformation of the elongated massaging recess at least radially inward along the longitudinal axis of the elongated massaging recess wherein the plurality of bearing surfaces are formed by a plurality of bearing elements, which are lined up along the longitudinal axis (LA) and the plurality of bearing surfaces are driven by at least one shaft, the at least one shaft comprising at least one eccentric section to produce a radial stroke movement.

2. The massaging device according to claim 1, wherein the elongated massaging recess is formed by an at least sectionwise tubular formed part made of a rubber-elastic material and the plurality of bearing surfaces bear at least partially on a lateral surface of an elastic formed part.

3. The massaging device according to claim 1, wherein the plurality of bearing surfaces are arranged concentrically around the longitudinal axis (LA) or radially offset to the longitudinal axis (LA) of the massaging recess.

4. The massaging device according to claim 1, wherein the oscillating deformation along the longitudinal axis (LA) of the elongated massaging recess in a circumferential direction of the elongated massaging recess is out of phase.

5. The massaging device according to claim 1, wherein the drive mechanism is for a wave-like deformation of the elongated massaging recess, in the form of a wave progressing along the longitudinal axis (LA) of the elongated massaging recess.

6. The massaging device according to claim 1, wherein the plurality of bearing elements comprise at least one guide opening for holding the at least one shaft.

7. The massaging device according to claim 1, wherein the plurality of bearing elements are jaws, disks, balls, bristles or a combination thereof.

8. The massaging device according to claim 1, wherein the plurality of bearing elements are made of a solid or elastically deformable material, metal, plastic, elastomer, foamed polyurethane or a combination thereof.

9. The massaging device according to claim 1, wherein the plurality of bearing elements are different at least sectionwise along the longitudinal axis (LA).

10. The massaging device according to claim 1, wherein the plurality of support elements are arranged in a common plane perpendicular to the longitudinal axis (LA) of the elongated massaging recess and form one group of support elements, and a plurality of such groups is provided successively along the longitudinal axis (LA) of the elongated massaging recess.

11. The massaging device according to claim 1, wherein a plurality of successive, at least sectionwise, circular ring-shaped bearing elements with at least one guide opening are provided along the longitudinal axis (LA) of the elongated massaging recess.

12. The massaging device according to claim 11, wherein at least one rod-shaped guide or support element is guided through the at least one guide opening.

13. The massaging device according to claim 12, wherein on the at least one rod-shaped guide or support element, several jaw-shaped or at least sectionwise circular ring-shaped bearing elements are lined up, the at least one rod-shaped guide or support element being approximately parallel to the longitudinal axis (LA) of the receiving space and arranged at a distance to said axis.

14. The massaging device according to claim 13, wherein the at least one rod-shaped guide or support element with lined-up bearing elements are provided concentrically around the longitudinal axis (LA).

15. The massaging device according to claim 14, wherein for driving the lined-up bearing elements on a rod-shaped guide or support element, the at least one shaft acts upon one circumferential side of the bearing elements.

16. The massaging device according to claim 1, wherein for moving the bearing surfaces or the plurality of bearing elements forming said bearing surfaces, the at least one shaft comprising the at least one eccentric section is provided, the at least one shaft interacts with the plurality of bearing elements and is driven by a drive unit.

17. The massaging device according to claim 16, wherein the at least one eccentric section extends parallel or approximately parallel to the longitudinal axis (LW) of the shaft at least over a partial length of the at least one shaft.

18. The massaging device according to claim 16, wherein the at least one eccentric section extends diagonally to the longitudinal axis (LW) of the shaft at least over a partial length of the at least one shaft.

19. The massaging device according to claim 16, wherein the at least one eccentric section extends spirally around the longitudinal axis (LW) of the shaft at least over a partial length of the at least one shaft.

20. The massaging device according to claim 1, wherein the at least one eccentric section is formed by one edge of the at least one shaft.

21. The massaging device according to claim 1, wherein the eccentric section comprises at least one shaft, the at least one shaft comprises at least partially a non-circular cross section that is a polygonal cross-section, essentially polygonal cross-section or an oval cross section.

22. The massaging device according to claim 1, wherein the at least the eccentric section is surrounded by an elastically deformable material, an elastomer or a foamed polyurethane material.

* * * * *